US007444696B2

(12) United States Patent
Lin et al.

(10) Patent No.: US 7,444,696 B2
(45) Date of Patent: Nov. 4, 2008

(54) FALL-PREVENTION DEVICE FOR THE BACKREST OF HOSPITAL BED

(75) Inventors: Hsiang-Suen Lin, Taichung (TW); Wen-Huei Chung, Taichung (TW)

(73) Assignee: Aerospace Industrial Development Corporation, Taichung (TW)

( * ) Notice: Subject to any disclaimer, the term of this patent is extended or adjusted under 35 U.S.C. 154(b) by 196 days.

(21) Appl. No.: 11/520,578

(22) Filed: Sep. 14, 2006

(65) Prior Publication Data

US 2008/0066232 A1 Mar. 20, 2008

(51) Int. Cl.
*A47C 21/08* (2006.01)

(52) U.S. Cl. ..... 5/613; 5/424; 5/430; 5/428

(58) Field of Classification Search ..... 5/185, 5/186.1, 424–430, 613; 296/20
See application file for complete search history.

(56) References Cited

U.S. PATENT DOCUMENTS 6,374,437 B1 * 4/2002 Voelker ..... 5/600
6,795,988 B2 * 9/2004 Hueppe ..... 5/426
6,916,056 B2 * 7/2005 Mitchell et al. ..... 296/20
6,983,496 B1 * 1/2006 Hernandez ..... 5/93.1
7,111,340 B2 * 9/2006 Mitchell et al. ..... 5/185

* cited by examiner

*Primary Examiner*—Fredrick Conley
(74) *Attorney, Agent, or Firm*—Rosenberg, Klein & Lee

(57) ABSTRACT

The present invention is a fall-prevention device for the backrest of a hospital bed, wherein fall-prevention devices are configured on both sides of the backrest rack which inclination angle can be adjusted. The fall-prevention device includes fall-prevention racks that are coupled to the both sides of the backrest rack of the hospital bed. The fall-prevention rack is located within the siderail and supported by a support member. The other end of the support member is activated by a linking rod that is pivotably connected to the siderail on one end and to the main bed frame on the other end. When the backrest rack is in flat position, the level distance between the linking rod and the backrest rack is the longest, thus the support member of the linking rod is unable to support the fall-prevention rack upward. When the backrest rack is in tilt position, by the change of the inclination angle of the backrest rack, one end of the inking rod is in fixed position and the other end is driven by the backrest rack to change the level distance between the linking rod and the backrest rack, so the support member is able to support the fall-prevention rack that would be turned on the backrest rack pivot part until the fall-prevention rack is in vertical position to securely support two sides of the patient and prevent the patient from falling without extra adjustment. Then the objectives of convenience in use and ensuring patients safety are attained.

9 Claims, 9 Drawing Sheets

FALL-PREVENTION DEVICE FOR THE BACKREST OF HOSPITAL BED

FIELD OF THE INVENTION

The present invention relates to a fall-prevention device for the backrest of a hospital bed, and more particularly to a fall-prevention rack configured on both sides of the backrest rack of a hospital bed that can be raised automatically when the backrest rack is tilt up and the inclination angle of the backrest rack is changed, with such a mechanism in a hospital bed the objective of protecting patients would be attained.

BACKGROUND OF THE INVENTION

As per the conventional hospital bed, to make easy for heavily ill patients to be moved on hospital bed, a plenty of designs such as mechanisms for tilting up and down the backrest rack or turning patients over have been equipped, yet the device on both sides of hospital bed to protect patients from falling has been retained conventional guardrail, i.e. a guardrail mechanism installed on both sides of hospital bed frame that can be pulled up or dropped down at any time, however such guardrail mechanism has shortcomings in use, which are:

1. Fixed height of guardrails: when the guardrails are pulled up on both sides of a flat hospital bed, they are fixed above the hospital bed naturally forming a barricade between patient and nurse; besides, although they can prevent patients from falling down to the side of the hospital bed, the protection to patients is limited up to a certain height, when backrest of the hospital bed is tilt up, it is possible that the patient's head or even the upper half of the patient's body would be raised higher than the height of the guardrails, and when the heavily ill patient is suddenly unconscious or becoming too weak to sustain him(her)self, it is very possible that the side leaned patient can not be put back right to position because of the neglect of nursing person causing the risk of making the patient leaned over the guardrail and falling down from hospital bed, which is presumed to be avoidable for the hurt from happening.

2. Extremely inconvenient in use: the use of the guardrails is to pull up or drop down by manual, when a patient is too weak to pull up the guardrails, it is necessary to get help from nursing person or others around and then the desirable protection of the guardrails for a backrest raised hospital bed can be got, therefore it is inconvenient in use.

SUMMARY OF THE INVENTION

<Technical Problems to be Resolved>

Being aware of the shortcomings mentioned above, to have automatic fall-prevention function on both sides of the backrest rack of a hospital bed for attaining the objective in safety for optimal protection to patients, the inventors developed a fall-prevention device for the backrest of a hospital bed that be fulfill the requirement mentioned above.

<Technical Measures and Efficacies>

The main purpose of the present invention is to provide a fall-prevention device for the backrest of a hospital bed, of which fall-prevention racks are configured on both sides of the backrest rack, with linking rods installed underneath the fall-prevention racks, that can adjust themselves the level distance from the backrest rack as per different inclination angle of the backrest rack, and support members on the linking rods, the fall-prevention racks would be pushed up to make the fall-prevention rack have different tilt angle relative to the backrest rack as the inclination angle of the backrest rack is changed to securely protect two sides of the patient, effectively prevent the patient from falling when the backrest rack is rising, and then the use of hospital bed in safety and convenience in use are promoted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
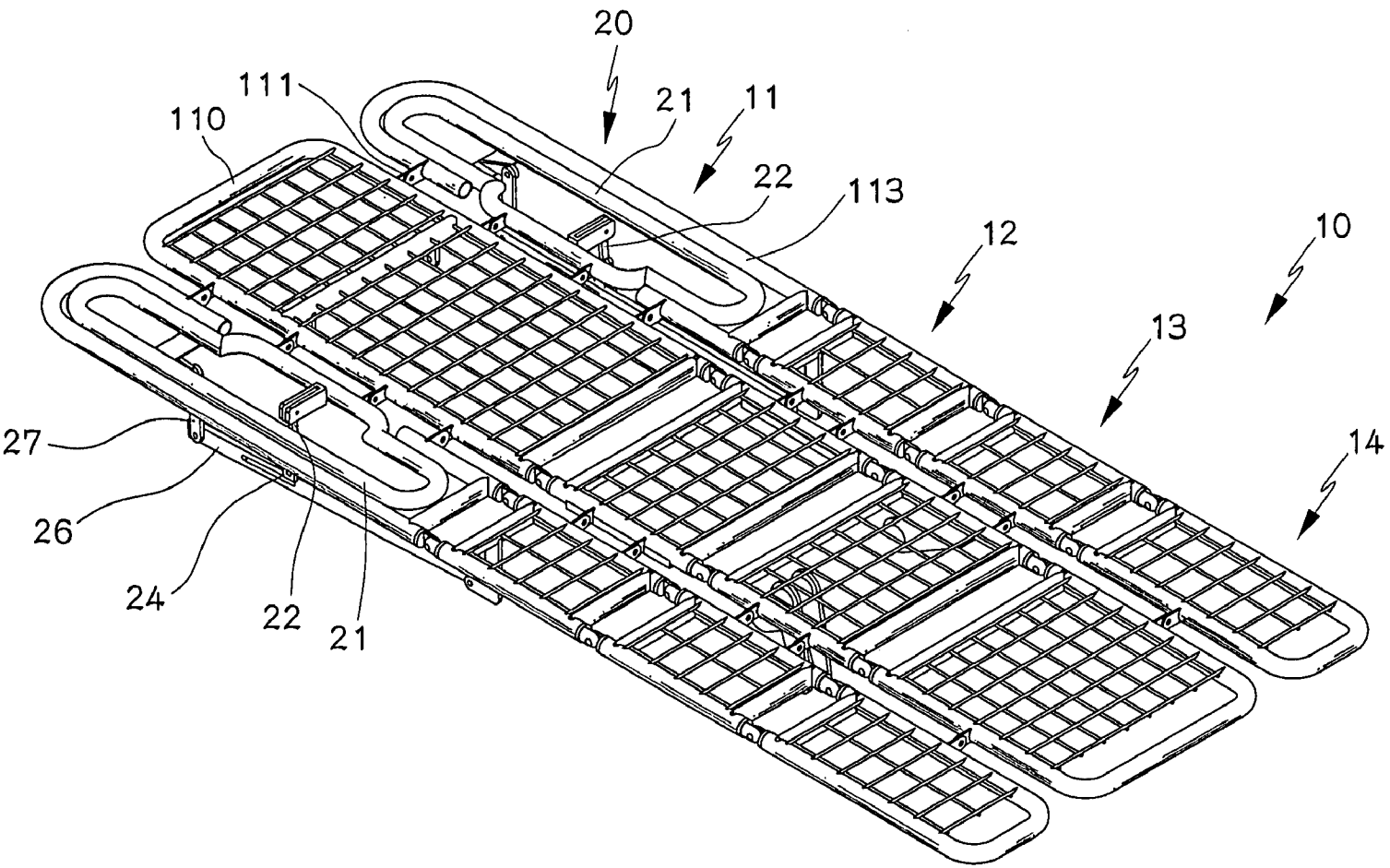
FIG. 1 is a perspective view of the main bed frame of the hospital bed of the present invention.
Figure 2:
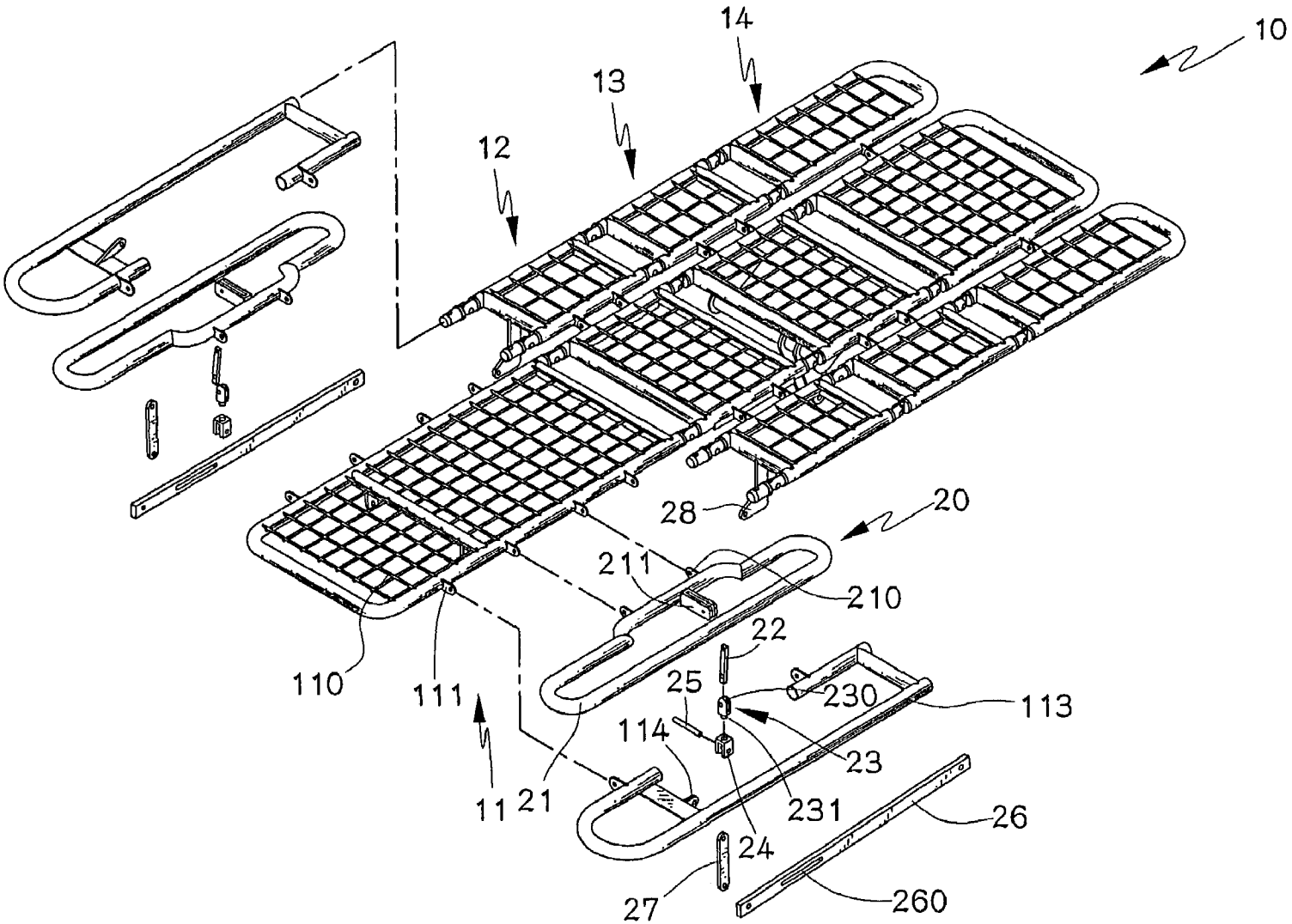
FIG. 2 is an exploded view of the main bed frame and the fall-prevention device of the hospital bed of the present invention.
Figure 3:
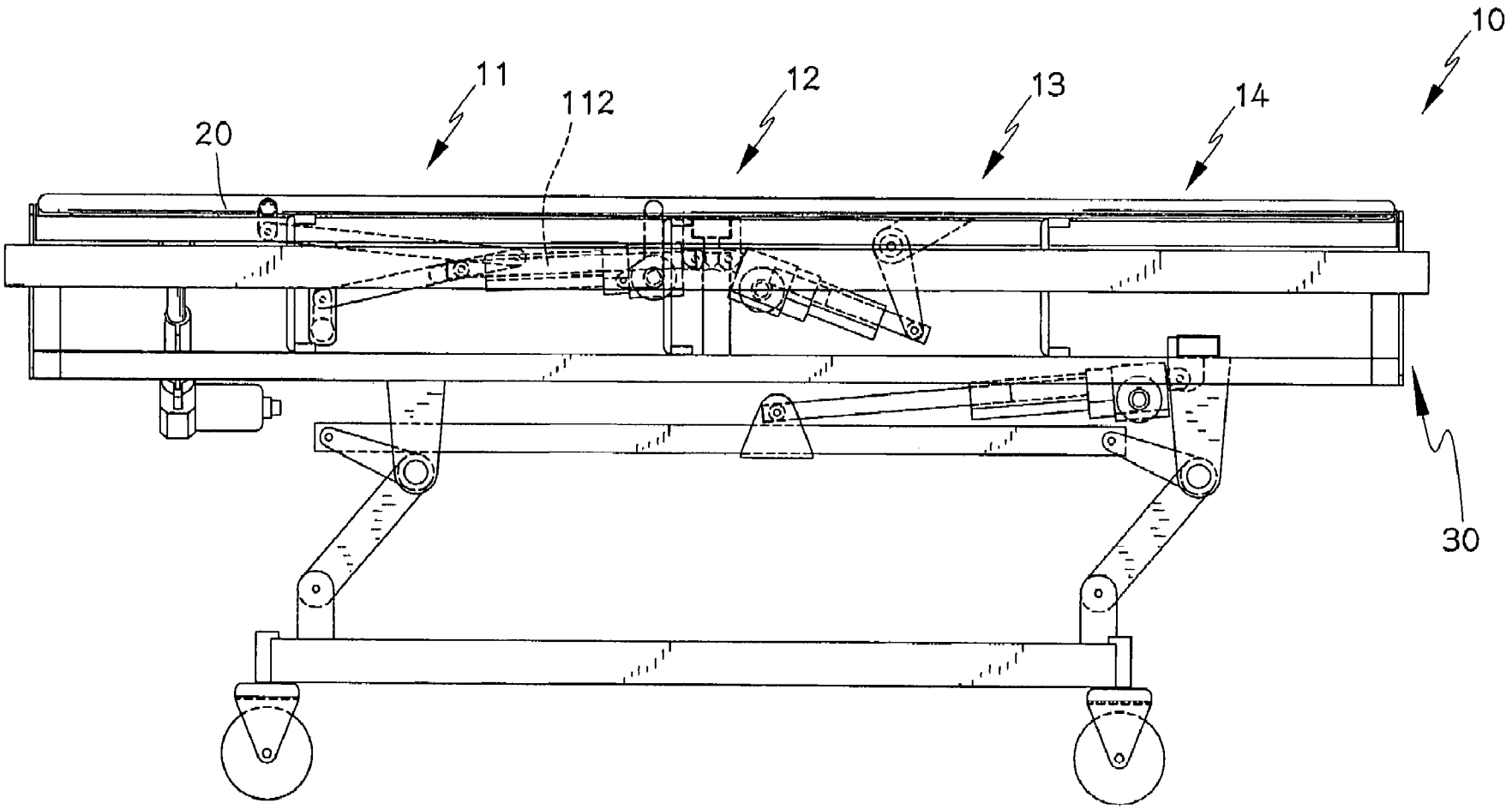
FIG. 3 is a side view of the combination of the main bed frame and the base frame of the present invention.
Figure 4:
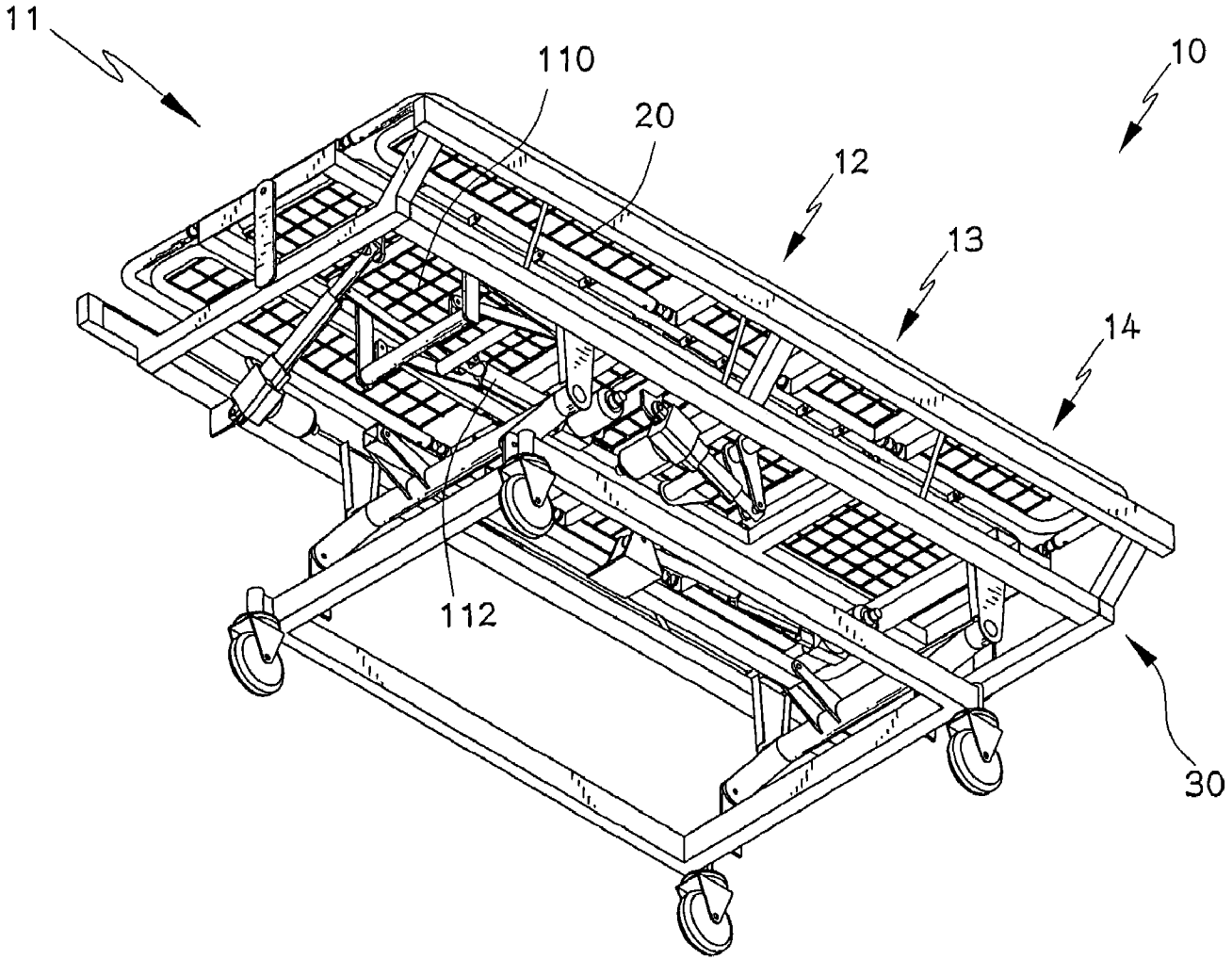
FIG. 4 is an upward view of the combination of the main bed frame and the base frame of the present invention.

Referring to FIGS. 1 to 4, a hospital bed structure of the present invention includes a main bed frame 10 consisting of four sections which are a back frame section 11, a seat frame section 12, a thigh frame section 13 and a leg frame section 14, and the back frame section 11 equips with fall-prevention devices 20 on both sides, the whole structure is mounted on a base frame 30.

The above-mentioned back frame section 11, seat frame section 12, thigh frame section 13 and leg frame section 14 are pivotably connected with each other as a structure of articulating deck. The features of the present invention are:

The back frame section 11 comprises a backrest rack 110 that is structured by a frame of big diameter tube with fine net inside the frame. Both sides of the backrest rack 110 are equipped with several sets of lugs of pivot parts 111 to pivotably connect with lateral equipments. A backrest actuator 112 is installed under the backrest rack 110, and the other end of the backrest actuator 112 is pivotably connected to the base frame 30 to elevate the backrest rack 110, which can also be done by manual operation, yet not to be herewith described further because it is commonly known and not a feature of this invention.

Both sides of the backrest rack 110 have U-shaped frame of siderails 113, each of the siderails 113 has a lug of pivot part 114 located near the height of patient's head for connecting with the components of the fall-prevention device 20.

A fall-prevention rack 21 of the fall-prevention device 20 is equipped within the U-shaped frame of the siderail 113, the fall-prevention rack 21 is a bulgy frame formed by surrounding a big diameter tube. The bulge side of the fall-prevention rack 21 has several lugs of pivot parts 210 pivotably connected with the pivot parts 111 of the backrest rack 110, so the fall-prevention rack 21 can use the pivot parts 111 as the rotation axis to be lifted or set flat on both sides of the backrest rack 110.

The fall-prevention rack 21 configures a driven part 211 of twin plates on the side opposite to the pivot parts 210, the free end of the driven part 211 is pivotably connected to a support member 22 that shapes as a plate. One end of the support member 22 is pivotably connected with the driven part 211 and the other end is pivotably connected with a joint 23. One end of the joint 23 is a groove-shaped connecting part 230 relative to the support member 22, and the other end is a cylinder of axial-turning part 231 which inserts into a reverse U-shaped guiding member 24, a guiding shaft 25 penetrates through the indentation of the guiding member 24 and connects in sliding with a linking rod 26, with which the linking rod 26 can activate the support member 22, and with the joint 23, there are at least two aspects of motional freedom between the support member 22 and the guiding member 24 for supporting or descending the fall-prevention rack 21 efficiently.

The U-shaped indentation of the guiding member 24 crosses over the linking rod 26 that is a long rod, and the linking rod 26 has a slot of guiding part 260 relative to the guiding member 24 for the guiding shaft 25 penetrating through therein, so the linking rod 26 can activate the support member 22 and the fall-prevention rack 21 through guiding member 24. A plate of connecting piece 27 connects the linking rod 26 with the pivot part 114 of the siderail 113, and the other end of the linking rod 26 is pivotably connected to a L-shaped plate of base connecting part 28 relative to the seat frame section 12 of the main bed frame 10.

Figure 5:
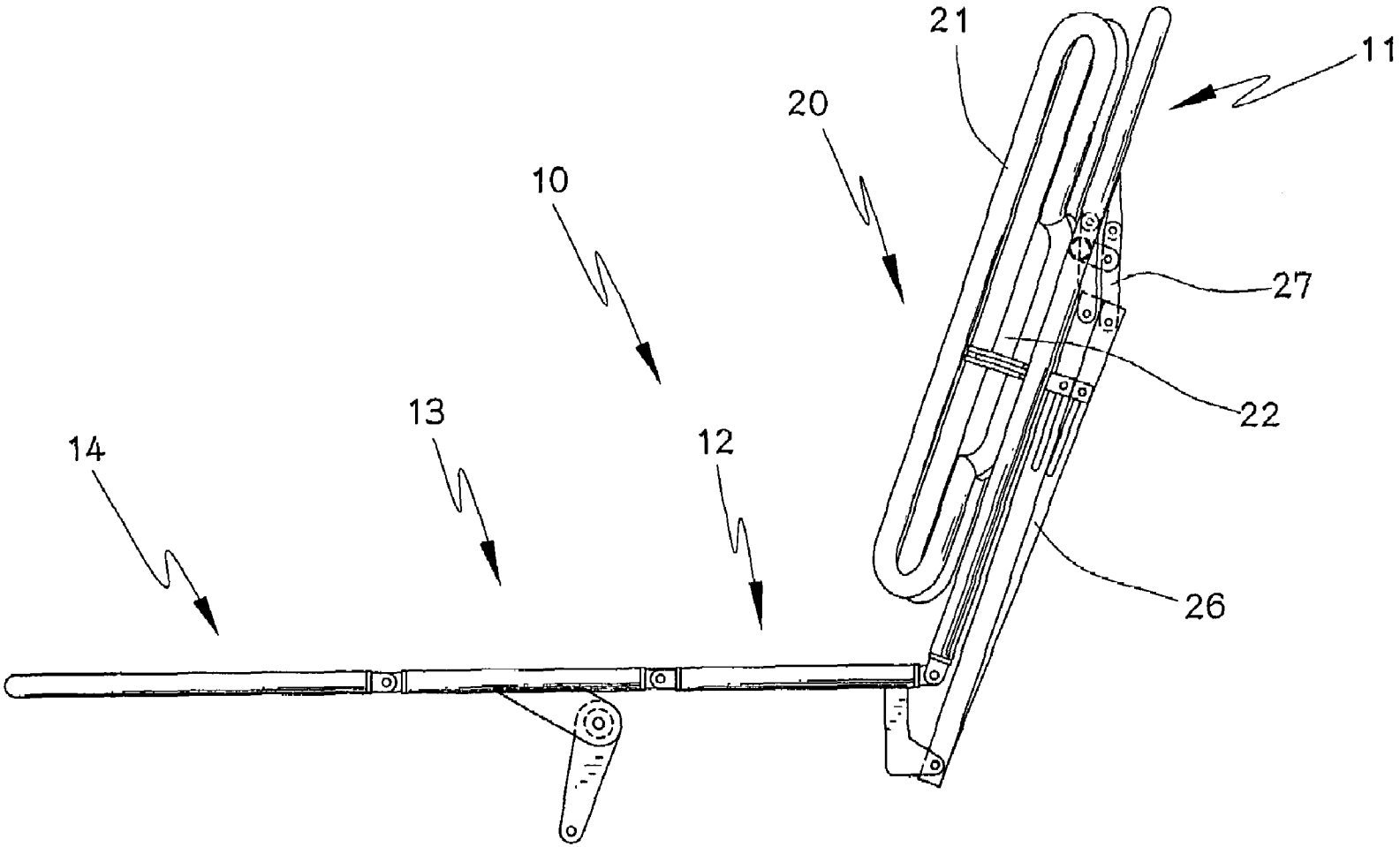
FIG. 5 is a side view showing the backrest rack elevated and the fall-prevention rack of the fall-prevention device elevated in coordination of the present invention.
Figure 6:
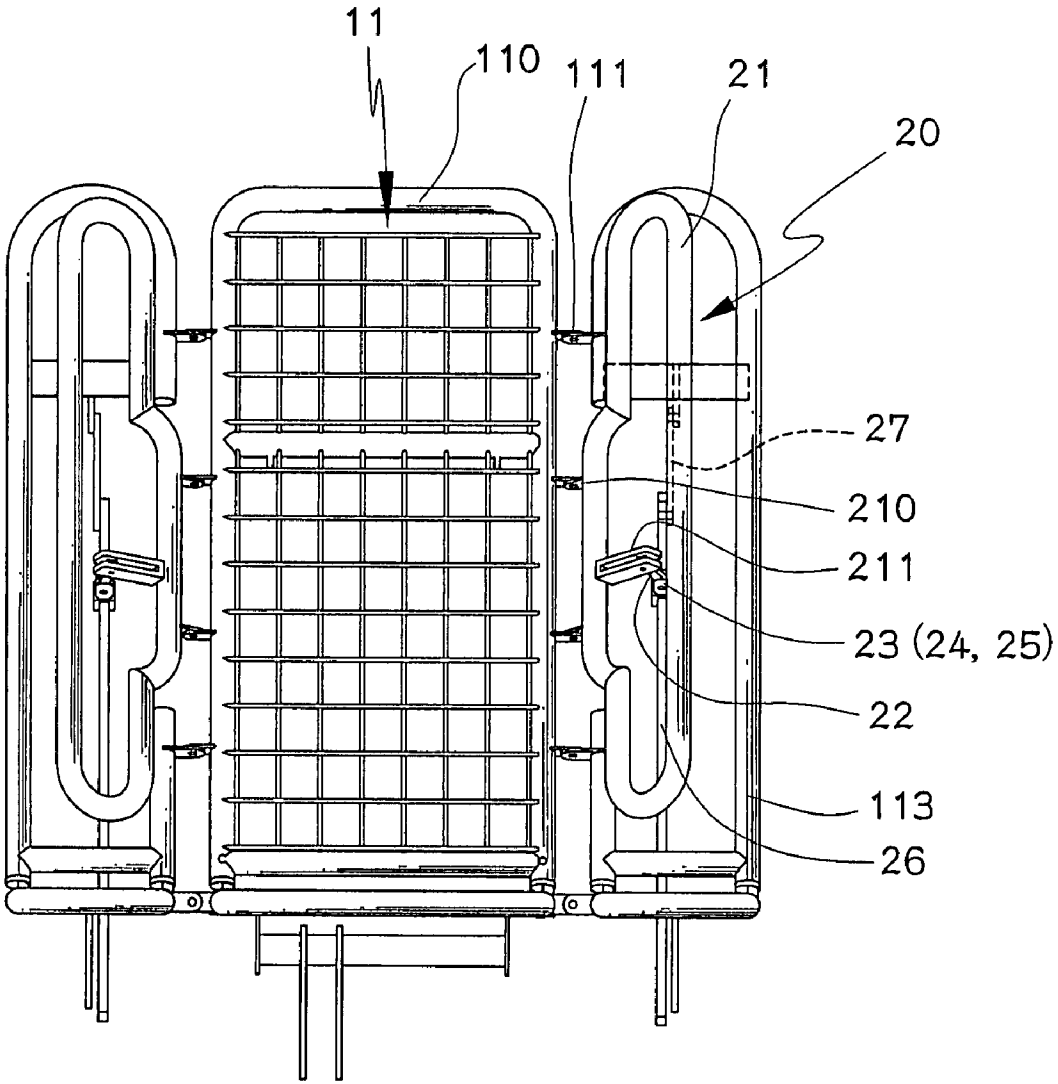
FIG. 6 is a front view showing the backrest rack elevated and the fall-prevention rack of the fall-prevention device elevated in coordination of the present invention.
Figure 7:
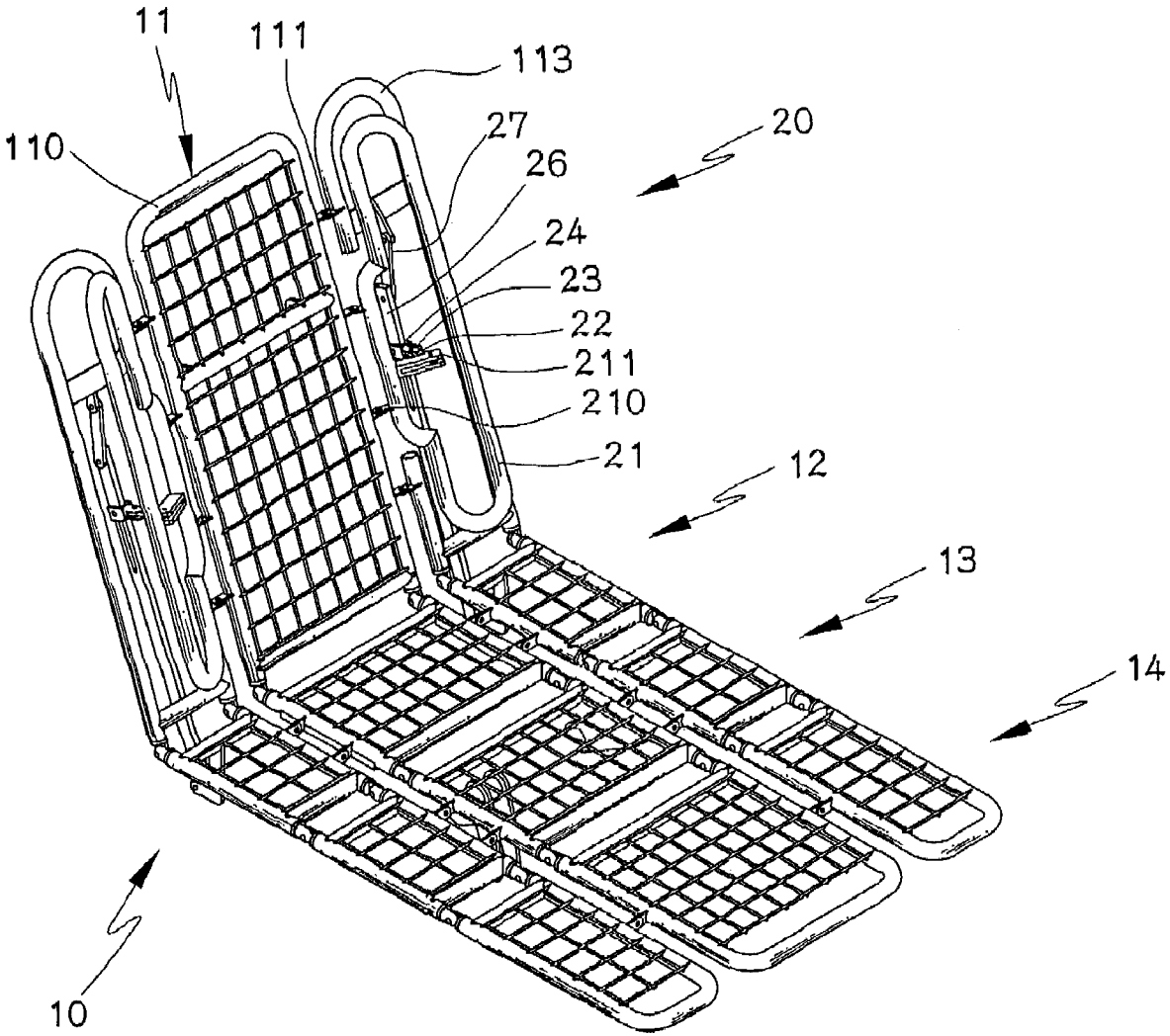
FIG. 7 is a perspective view showing the backrest rack elevated and the fall-prevention rack of the fall-prevention device elevated in coordination of the present invention.

When the main bed frame 10 is in its horizontal position, the level distance between the linking rod 26 and the backrest rack 110 is the longest, which means the support member 22 on the linking rod 26 is unable to lift the fall-prevention rack 21. When the backrest rack 110 is elevated by the backrest actuator 112 to change the angle of inclination, the end of the linking rod 26 connecting to the base connecting part 28 remains in position, but the other end is limited by the length of the connecting piece 27 to make the linking rod 26 approach toward the backrest rack 110. Therefore the level distance between the backrest rack 110 and the linking rod 26 is shortened, and with the cooperation of the guiding member 24 sliding along the linking rod 26, the joint 23 and the support member 22, so the support member 22 can lift the fall-prevention rack 21 upwardly. Thus, the fall-prevention rack 21 can use the pivot parts 210 and 111 as the rotation axis to be lifted or set flat on both sides of the backrest rack 110, as shown in FIGS. 5, 6 and 7, the backrest rack 110 and the fall-prevention racks 21 on both sides of the backrest rack 110 form a structure of concave to support both sides of patient and provide a firm fall-prevention structure. When the backrest rack 110 is set flat, the linking rod 26 returns to the status of having the longest level distance with the backrest rack 110, therefore the backrest rack 110 and the fall-prevention rack 21 are on the same level.

Figure 8:
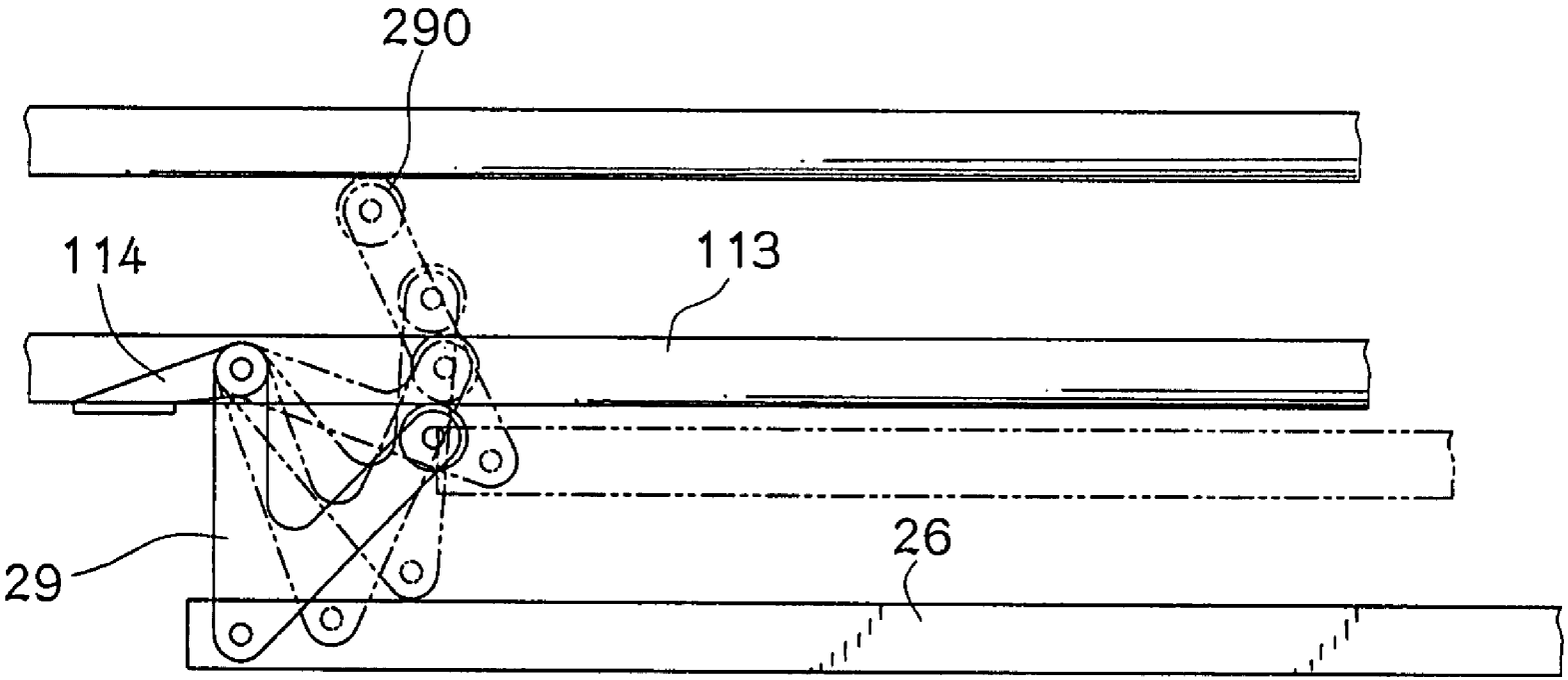
FIG. 8 is a partial plan view showing the second embodiment of the movement of the fall-prevention device of the present invention.

The support structure of the fall-prevention rack 21 of the fall-prevention device 20 can be simplified, as shown in FIG. 8, an integral support structure of support bracket 29 is installed between the linking rod 26 and the pivot part 114 of the siderail 113. One end of the support bracket 29 is pivotably connected with the pivot part 114 of the siderail 113, the middle portion is pivotably connected with the linking rod 26 and the free end is equipped with a rotatable roller of support piece 290 which supports the under side of the fall-prevention rack 21. Therefore when the inclination angle of the backrest rack 110 is changed, the level distance between the linking rod 26 and the backrest rack 110 is changed too, which activates the support bracket 29 to move the fall-prevention rack 21 upward or downward with the support piece 290, the function of above-mentioned structure can be attained.

Figure 9:
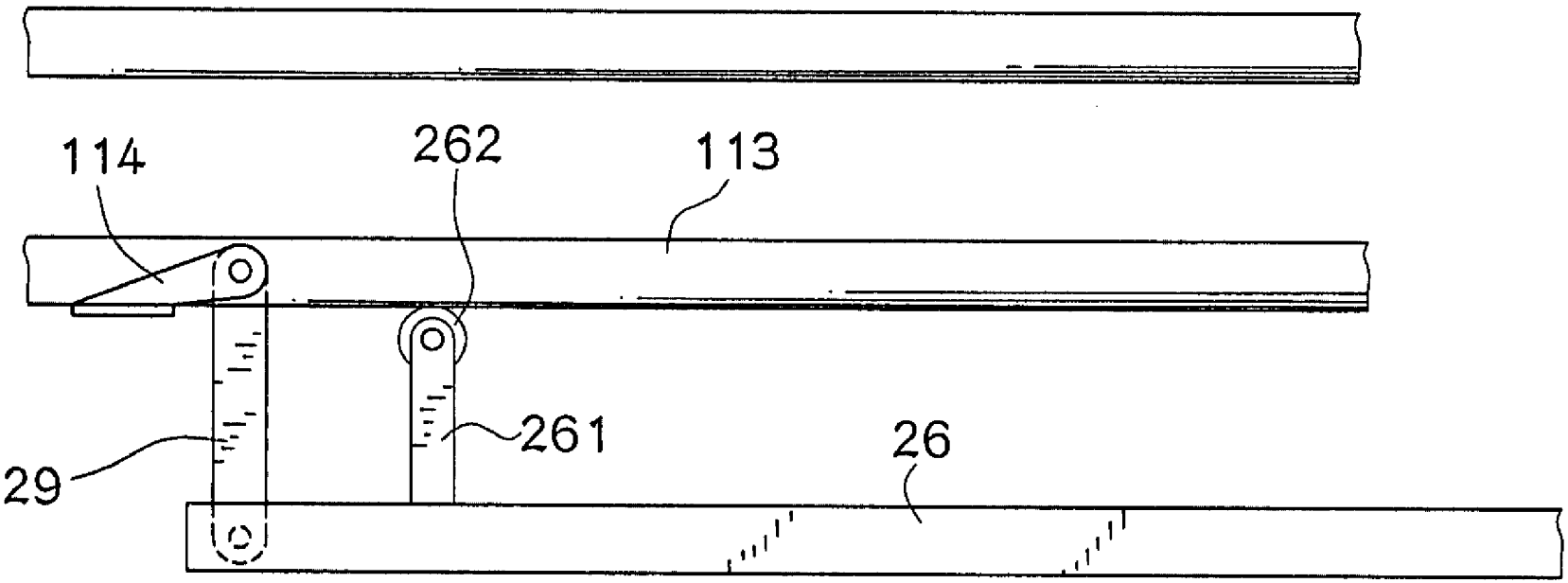
FIG. 9 is a partial plan view showing the third embodiment of the movement of the fall-prevention device of the present invention.

The support structure of the fall-prevention rack 21 of the fall-prevention device 20 can be simplified, as shown in FIG. 9, a connecting rod of support bracket 29 is installed between the linking rod 26 and the pivot part 114 of the siderail 113. One end of the support bracket 29 is pivotably connected with the pivot part 114 of the siderail 113, and the free end is pivotably connected with the linking rod 26. The support structure is integrally formed with the linking rod 26, that is to say, a rod support rack 261 is extended from the middle section of the linking rod 26 to the under side of the fall-prevention rack 21. The other end of the support rack 261 is equipped with a roller of support piece 262 which supports the under side of the fall-prevention rack 21. When the position of the linking rod 26 is changed, which activates the support piece 262 to change the inclination angle of the fall-prevention rack 21, the function of above-mentioned structure can also be attained.

With implementation of the structure described above, the functions as following would be derived:

1. Convenience in using: when the inclination angle of the backrest rack 110 is changed, the tilt angle of the fall-prevention rack 21 can be changed automatically to support both sides of the patient, it is not necessary to have extra assistance, and the function of convenience is using will be attained.

2. Optimal safety: the fall-prevention rack 21 of the fall-prevention device 20 can be raised or lowered automatically with the change of inclination angle of the backrest rack 110, therefore protecting patient from falling sideways, the objective of protecting patient's safety will be attained.

While we have shown and described the embodiment in accordance with the present invention, it should be clear to those skilled in the art that further embodiments may be made without departing from the scope of the present invention.

What is claimed is:

1. A fall-prevention device for the backrest of a hospital bed comprising:

a main bed frame including at least a back frame section and a seat frame section, said back frame section equipped with a fall-prevention device;

said back frame section including a backrest rack equipping with siderails on both sides, a fall-prevention rack of said fall-prevention device located within said siderail, said fall-prevention rack being pivotably connected with said backrest rack, thus, said fall-prevention rack being able to use pivot parts as a rotation axis to be lifted or set flat on both sides of said backrest rack; and a free end of said fall-prevention rack being activated by a support member, the other end of said support member being coupled to a linking rod, one end of said linking rod being connected to said seat frame section, and the other end of said linking rod being connected to said siderail.

2. The fall-prevention device for the backrest of a hospital bed as claimed in claim 1, wherein said main bed frame includes said back frame section, said seat frame section, a thigh frame section and a leg frame section which are pivotably connected with each other as a structure of articulating deck, the whole structure is mounted on a base frame.

3. The fall-prevention device for the backrest of a hospital bed as claimed in claim 2, wherein said back frame section includes a backrest rack that is structured by a frame of big diameter tube with fine net inside the frame, both sides of said backrest rack is equipped with several sets of lugs of pivot parts, a backrest actuator is installed under said backrest rack, and the other end of said backrest actuator is pivotably connected to said base frame.

4. The fall-prevention device for the backrest of a hospital bed as claimed in claim 1, wherein both sides of said backrest rack have U-shaped frame of siderails, each of said siderails has a lug of pivot part near the height of the patient's head for connecting with components of said fall-prevention device.

5. The fall-prevention device for the backrest of a hospital bed as claimed in claim 1, wherein said fall-prevention rack of said fall-prevention device is equipped within the U-shaped frame of said siderail, said fall-prevention rack is a bulgy frame formed by surrounding a big diameter tube, a bulge side of said fall-prevention rack has several lugs of pivot parts pivotably connected with a relative structure of said backrest rack, said fall-prevention rack has a driven part on the side opposite to said pivot parts, one free end of said driven part is pivotably connected to said support member, and the other end of said support member is pivotably connected with a joint, one end of said joint is a connecting part relative to said support member, and the other end is an axial-turning part which inserts into a reverse U-shaped guiding member, a guiding shaft penetrates through the indentation of the guiding member and connects in sliding with said linking rod.

6. The fall-prevention device for the backrest of a hospital bed as claimed in claim 5, wherein the U-shaped indentation of said guiding member crosses over said linking rod which is a long rod, and said linking rod has a slot of guiding part relative to said guiding member for said guiding shaft penetrating through therein.

7. The fall-prevention device for the backrest of a hospital bed as claimed in claim 1, wherein said linking rod is equipped with a plate of connecting piece relative to said siderail, and the other end of said linking rod is pivotably connected to a L-shaped plate of base connecting part relative to said seat frame section of said main bed frame.

8. The fall-prevention device for the backrest of a hospital bed as claimed in claim 1, wherein a support structure of said fall-prevention rack of said fall-prevention device is an integral support structure of support bracket installed between said linking rod and said siderail, one end of said support bracket is pivotably connected with said siderail, the middle portion is pivotably connected with said linking rod and the free end is equipped with a rotatable roller of support piece which supports the under side of said fall-prevention rack.

9. The fall-prevention device for the backrest of a hospital bed as claimed in claim 1, wherein a, support structure of said fall-prevention rack of said fall-prevention device is a connecting rod of support bracket installed between said linking rod and said siderail, one end of said support bracket is pivotably connected with said siderail, and the other end is pivotably connected with said linking rod, said linking rod has a rod support rack on the middle section, the other end of said support rack is equipped with a roller of support piece which supports the under side of said fall-prevention rack.

* * * * *